US010330048B2

(12) United States Patent
Xue

(10) Patent No.: US 10,330,048 B2
(45) Date of Patent: Jun. 25, 2019

(54) FUEL ENRICHMENT SIMPLE STARTING DEVICE AND METHOD OF CARBURETOR

(71) Applicant: Meiying Xue, Hangzhou (CN)

(72) Inventor: Meiying Xue, Hangzhou (CN)

( * ) Notice: Subject to any disclaimer, the term of this patent is extended or adjusted under 35 U.S.C. 154(b) by 0 days.

(21) Appl. No.: 15/417,040

(22) Filed: Jan. 26, 2017

(65) Prior Publication Data

US 2018/0119646 A1 May 3, 2018

(30) Foreign Application Priority Data

Oct. 30, 2016 (CN) ..... 2016 1 0925134

(51) Int. Cl.

| | |
|---|---|
| ***F02M 1/16*** | (2006.01) |
| ***F02M 1/02*** | (2006.01) |
| ***F02M 17/04*** | (2006.01) |
| *F02N 3/02* | (2006.01) |
| *F02B 63/00* | (2006.01) |

(52) U.S. Cl.

CPC ..... *F02M 1/02* (2013.01); *F02M 1/16* (2013.01); *F02M 17/04* (2013.01); *F02B 63/00* (2013.01); *F02N 3/02* (2013.01)

(58) Field of Classification Search

CPC .. F02M 1/02; F02M 1/16; F02B 63/00; F02N 3/02

See application file for complete search history.

(56) References Cited

U.S. PATENT DOCUMENTS

| | | | | |
|---|---|---|---|---|
| 3,685,809 | A | 8/1972 | Manning | |
| 3,977,380 | A | 8/1976 | Atumi et al. | |
| 4,079,708 | A | 3/1978 | Wieland et al. | |
| 4,177,784 | A | 12/1979 | Tatsutomi et al. | |
| 2002/0135082 | A1* | 9/2002 | Woody | F02M 1/16 261/35 |
| 2003/0111743 | A1 | 6/2003 | Ohgane et al. | |
| 2008/0135018 | A1* | 6/2008 | Keeton | F02D 41/062 123/437 |
| 2012/0318249 | A1* | 12/2012 | Warfel | F02M 1/02 123/704 |
| 2013/0213356 | A1 | 8/2013 | Murakami | |

FOREIGN PATENT DOCUMENTS

| | | | |
|---|---|---|---|
| EP | 0236858 | A2 | 9/1987 |

* cited by examiner

*Primary Examiner* — Stephen K Cronin
*Assistant Examiner* — Xiao En Mo
(74) *Attorney, Agent, or Firm* — Pedersen and Company, PLLC; Ken J. Pedersen; Barbara S. Pedersen

(57) ABSTRACT

This present invention relates to the field of carburetor, in particular, relates to a fuel enrichment simple starting device and method of carburetor, using pre-injection technology to achieve engine fuel enrichment start, That is, in the first step squeeze the purge bulb, pre-inject the quantitative fuel, and then use the choke of the large volume air to achieve simple start, steps: the first step, squeeze the purge bulb; the second step, close the choke; the third step, pull the engine starter to the engine running; the fourth step, increase and decrease the throttle to normal running. If using the fuel enrichment simple starting device and method of carburetor in the present invention, the engine can be started completely by above four steps, the starting device has the advantages of simple operation, less starting times and easy to start at low temperature (such as 0° C.).

9 Claims, 7 Drawing Sheets

FUEL ENRICHMENT SIMPLE STARTING DEVICE AND METHOD OF CARBURETOR

FIELD OF THE INVENTION

The present invention relates to the field of carburetor, in particular, relates to a fuel enrichment simple starting device and method of carburetor.

BACKGROUND OF THE INVENTION

When the engine is in the warm state, air-fuel ratio in the economy match in 13~15:1 set by the factory, but the engine in the cold start need 6~12:1 air-fuel ratio, so when the engine starts, the carburetor needs to provide additional fuel to the engine to ensure that the engine can start normally.

At present, the choke device is widely used to reduce the amount of air intake to get more fuel for the start, specific steps: the first step, squeeze the purge bulb; the second step, close the choke; the third step, open the throttle fully or set the throttle in the fast idle speed position; the fourth step, pull the engine starter, hear POP sound so far; the fifth step, pull the choke to the ½ position; the sixth step, pull the engine starter to the engine running; the seventh step, keep the engine running warm; the eighth step, pull the choke to the full open position; the ninth step, increase and decrease the throttle to normal running. The defects of using the present choke device are that: 1. steps are cumbersome; 2. it is difficult to judge POP sound, the engine is difficult to start; 3. the engine is difficult to start or cannot start at low temperatures (such as 0° C.).

For example, the Publication No. CN1055151C Chinese invention patent, discloses an auxiliary starting passage structure of carburetor, an auxiliary starting body is additionally installed relative to the carburetor body, and on the structural surface is provided with a connecting groove, the connecting groove connects the connecting hole of the main air passage cross hole and the air inlet of auxiliary starting body side to form a subordinate type. But on the bonding surface is not provided with the connecting groove, the bonding surface covers the connecting hole, and in the side of carburetor body sets a cross hole to connect the air inlet and the main hole, the connecting hole of the main hole opening in the mounting seat connect with the air inlet on the bonding surface to form an independent type. The structure of the auxiliary starting passage is complicated, and the operation steps are cumbersome, the engine is difficult to start or cannot start at low temperatures (such as 0° C.).

SUMMARY OF THE INVENTION

In order to solve the current technical defects, the present invention supply a fuel enrichment simple starting device and method of carburetor, use pre-injection technology to achieve engine fuel enrichment start, that is, in the first step squeeze the purge bulb, pre-inject the quantitative fuel, and then use the choke of the large volume air to achieve simple start.

The carburetor mentioned in the invention is used in two-stroke or four-stroke ignition gasoline engine; it is widely used in outdoor garden tools and other power equipment, due to the small displacement and handheld, mostly for use hand pull start.

A fuel enrichment simple starting device of carburetor, comprising a fuel pump chamber, a metering chamber, a purge bulb, a throttle bore, a choke and a fuel pump diaphragm, the starting device comprise three fuel circuit connected to the fuel enrichment chamber, the three fuel circuit are an fuel inlet passage, a fuel purge passage and a fuel enrichment starting passage respectively. When squeeze the purge bulb, pre-inject the quantitative fuel, and then use the choke of the large volume air to achieve simple start. The starting device has the advantages of simple operation, less starting times and easy to start at low temperature (such as 0° C.).

Preferably, the bottom of the purge bulb has a prime force transmission passage leading into the fuel pump chamber.

In any of the above schemes, one side of the fuel pump diaphragm is provided with a fuel enrichment chamber.

In any of the above schemes, the inlet of the fuel inlet passage is provided with a check valve with the spring.

In any of the above schemes, the fuel enrichment starting passage is provided with a check valve with a metering jet.

In any of the above schemes, the check valve with a metering jet is provided with a spring.

In any of the above schemes, the fuel enrichment starting passages is also provided with a pressure balance hole and connects with the air of the choke direction.

In any of the above schemes, a venturi is provided between the throttle bore and the choke.

In any of the above schemes, the fuel pump diaphragm forms a pump with a check valve with the spring and a check valve with a metering jet.

In any of the above schemes, a separated remote control structure is used between the purge bulb and the main body of the carburetor, the purge bulb and the main body of the carburetor are connected by a fuel tube.

The working principle of the fuel enrichment simple starting device of carburetor in the present invention, when the operator squeezes the purge bulb, a positive pressure is generated during the pressing operation, and a negative pressure is generated during the releasing operation, the bottom of the purge bulb has a prime force transmission passage leading into the fuel pump chamber, the positive pressure and the negative pressure are introduced into the fuel pump chamber to drive the fuel pump diaphragm to produce reciprocating movement. When the operator squeezes the purge bulb, the air of carburetor will be discharged out through a fuel purge passage, and a portion of the fuel will enter the fuel pump chamber through the prime force transmission passage at the bottom of the purge bulb, the fuel pump diaphragm drives the fuel in the fuel enrichment chamber, the fuel is ejected from the check valve with a metering jet of the fuel enrichment starting passage; when the operator releases the purge bulb, a negative pressure generated by the purge bulb, and the fuel in the fuel container is sucked into the metering chamber of the carburetor, the excess fuel enters the fuel enrichment chamber and the fuel purge passage of the carburetor, so repeatedly, the fuel is injected into the throttle bore of the carburetor from the fuel enrichment starting passage.

A fuel enrichment simple starting method of carburetor, comprising the following steps:

First step, squeeze the purge bulb, pre-inject the quantitative fuel;

Second step, close the choke;

Third step, pull the engine starter to the engine running;

Fourth step, increase and decrease the throttle to normal running.

The starting method has the advantages of simple operation, less starting times and easy to start at low temperature (such as 0° C.).

Squeeze the purge bulb, which is a standard step when the engine starts, the purpose is to suck the fuel of the fuel container into the metering chamber of the carburetor, after the metering chamber of carburetor is filled with fuel, more fuel will through the fuel purge passage, and return to the fuel container by the duckbill check valve.

Preferably, in the first step squeeze the purge bulb, pre-inject the quantitative fuel, and then use the choke of the large volume air to achieve simple start; a positive pressure is generated when pressing the purge bulb and a negative pressure is generated when releasing the purge bulb.

In any of the above schemes, the bottom of the purge bulb has a prime force transmission passage leading into the fuel pump chamber, the positive pressure and the negative pressure are introduced into the fuel pump chamber to drive the fuel pump diaphragm to produce reciprocating movement, when the operator squeezes the purge bulb, the air of carburetor will be discharged out through a fuel purge passage, and a portion of the fuel will enter the fuel pump chamber through the (pump power) prime force transmission passage at the bottom of the purge bulb, the fuel pump diaphragm drives the fuel in the fuel enrichment chamber, the fuel is ejected from the check valve with a metering jet of the fuel enrichment starting passage.

In any of the above schemes, when the operator releases the purge bulb, a negative pressure generated by the purge bulb, and the fuel in the fuel container is sucked into the metering chamber of the carburetor, the excess fuel enters the fuel enrichment chamber and the fuel purge passage of the carburetor, so repeatedly, the fuel is injected into the throttle bore of the carburetor from the fuel enrichment starting passage to achieve start.

In any of the above schemes, when the operator squeezes the purge bulb, the start fuel under the pressure of the fuel pump diaphragm is injected into the carburetor through the check value of the fuel enrichment starting passage; the check valve of the fuel inlet passage is closed at this time.

In any of the above schemes, when the operator releases the purge bulb, the self-resilience of the purge bulb forms a negative pressure against the fuel pump diaphragm, at this time the check valve of the fuel inlet passage is opened, and suck in the fuel, the check valve with a metering jet of the fuel enrichment starting passage is closed, the fuel cavity is filled with fuel, to prepare for the second fuel injection cycle.

NUMBER DESCRIPTION IN THE DRAWINGS

Figure 11:
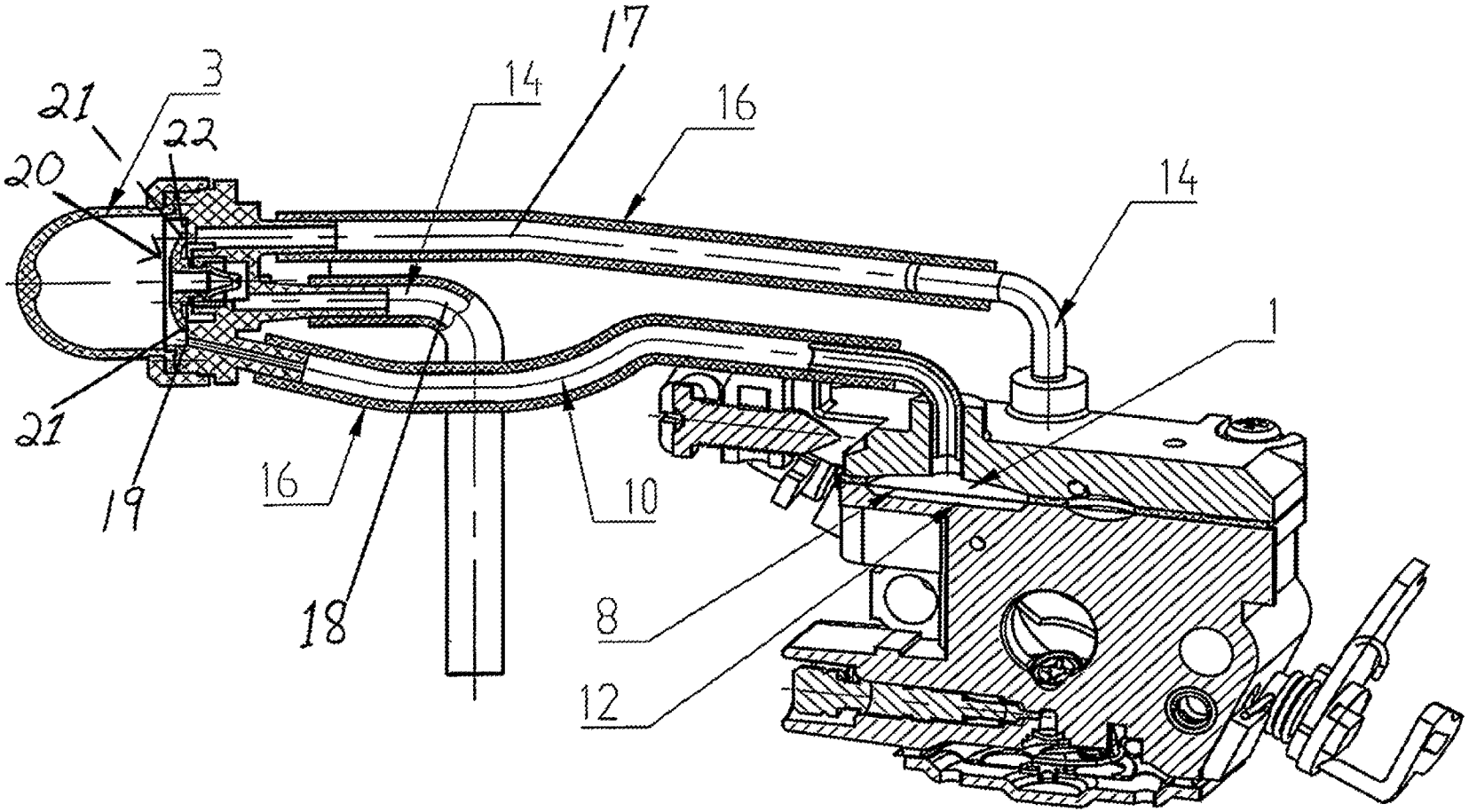
FIG. 11 is a structure schematic view of optimal embodiment in accordance to the present invention, the fuel enrichment simple starting device and method of carburetor.

Fuel pump chamber 1, Metering chamber 2, Purge bulb 3 with bulb check valve 20 having outer perimeter 21, Check valve 4, throttle bore 5, Choke 6, Venturi 7, Fuel pump diaphragm 8, Fuel inlet passage 9, (Pump power) Prime force transmission passage 10 wherein hole 19 for the first end of passage 10 is in the bottom wall 22 of the purge bulb 3, Check valve with a metering jet 11, Fuel enrichment chamber 12, Fuel enrichment starting passage 13, Fuel purge passage 14 comprising bulb inlet passage 17 and bulb outlet passage 18 (see FIG. 11), Pressure balance hole 15, Fuel tubes 16.

DETAILED DESCRIPTION

In order to understand the present invention better and clearly, a detail description with embodiment s is provided. But the present invention will be apparent various changes and modifications without exceeding the broader spirit and scope of the present invention as defined by claims. However, the following embodiments are just used to explain, and not limit the present invention.

Embodiment 1

As shown in FIGS. 1-7, a schematic view of optimal embodiment in accordance to the present invention, the fuel enrichment simple starting device and method of carburetor. The fuel enrichment simple starting device of carburetor in the present invention, comprising a fuel pump chamber 1, a metering chamber 2, a Purge bulb 3, a throttle bore 5, a choke 6 and a fuel pump diaphragm 8, the starting device comprise three fuel circuit connected to the fuel enrichment chamber 12, the three fuel circuit are an fuel inlet passage 9, a fuel purge passage 14 (as show in FIG. 10) and a fuel enrichment starting passage 10 respectively. When squeeze the purge bulb, pre-inject the quantitative fuel, and then use the choke of the large volume air to achieve simple start. The starting device has the advantages of simple operation, less starting times and low temperature (such as 0° C.) easy to start.

Figure 1:
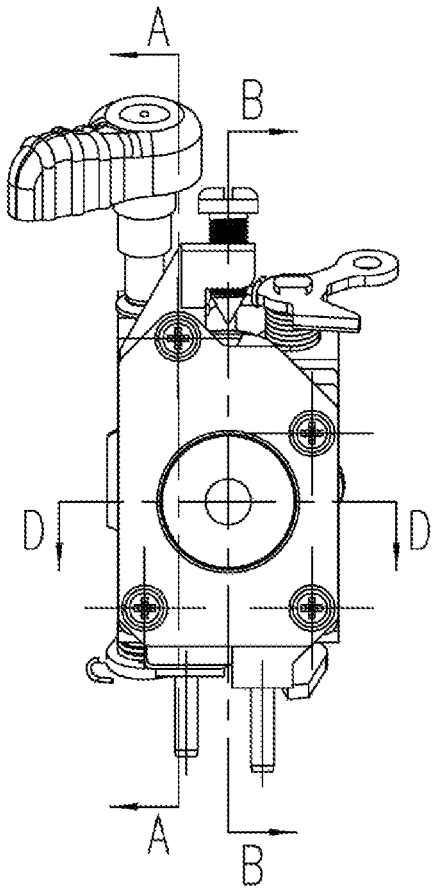
FIG. 1 is a schematic view of optimal embodiment in accordance to the present invention, the fuel enrichment simple starting device and method of carburetor.
Figure 6:
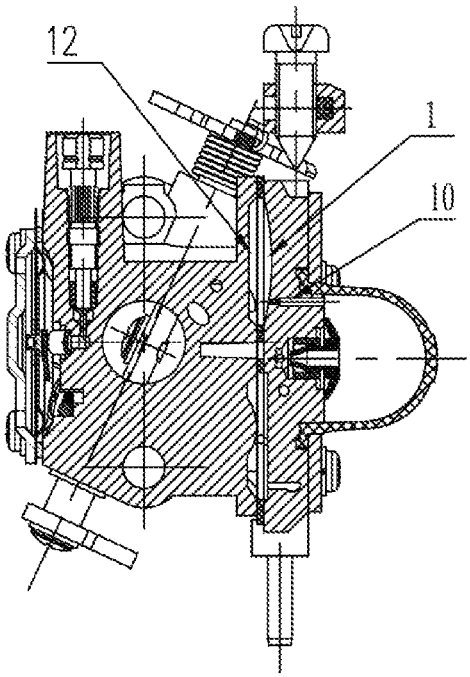
FIG. 6 is a B-B section view of the embodiment of FIG. 1 in accordance to the present invention, the fuel enrichment simple starting device and method of carburetor.

As shown in FIG. 6, a B-B section view of the embodiment of FIG. 1 in accordance to the invention, the fuel enrichment simple starting device and method of carburetor.

In the embodiment, one side of the fuel pump diaphragm 8 is provided with a fuel enrichment chamber 12.

Figure 2:
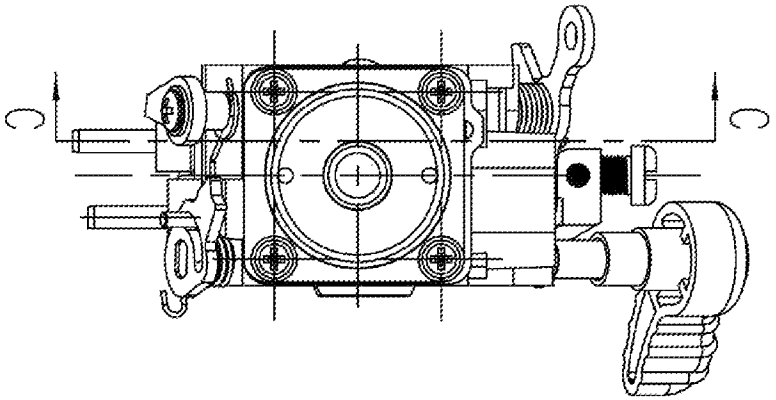
FIG. 2 is a rear view of the embodiment of FIG. 1 in accordance to the present invention, the fuel enrichment simple starting device and method of carburetor.
Figure 3:
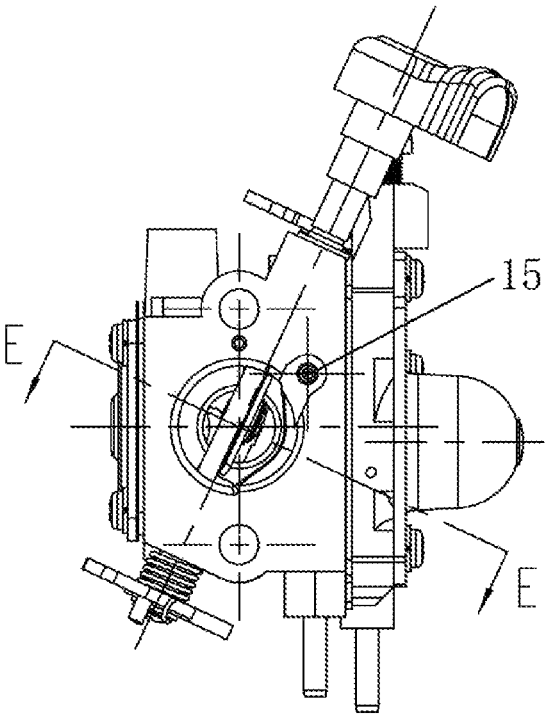
FIG. 3 is a left view of the embodiment of FIG. 1 in accordance to the present invention, the fuel enrichment simple starting device and method of carburetor.
Figure 4:
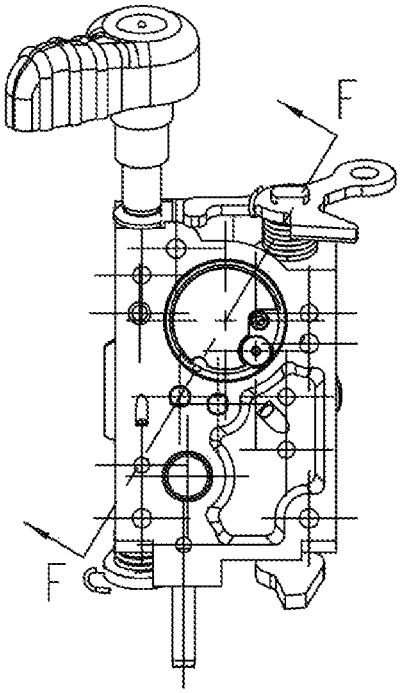
FIG. 4 is a top view removing the purge bulb and pump cover of the embodiment of FIG. 1 in accordance to the present invention, the fuel enrichment simple starting device and method of carburetor.
Figure 5:
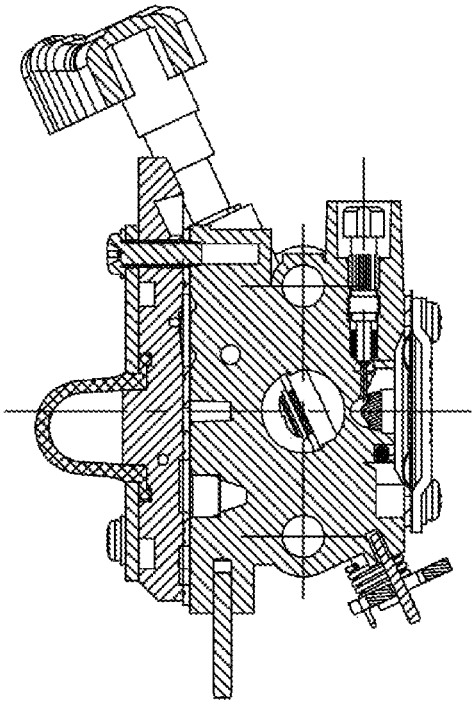
FIG. 5 is a A-A section view of the embodiment of FIG. 1 in accordance to the present invention, the fuel enrichment simple starting device and method of carburetor.
Figure 7:
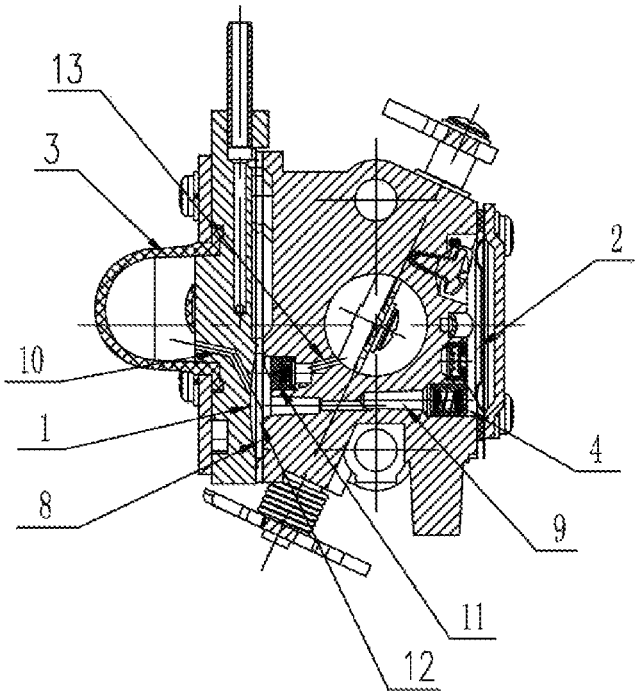
FIG. 7 is a C-C section view of the embodiment of FIG. 2 in accordance to the present invention, the fuel enrichment simple starting device and method of carburetor.

As shown in FIG. 7, a C-C section view of the embodiment of FIG. 2 in accordance to the invention, the fuel enrichment simple starting device and method of carburetor.

In the embodiment, the bottom (or bottom wall 22) of the purge bulb 3 has a hole 19 connecting with the fuel pump chamber 1, the positive pressure and the negative pressure are introduced into the fuel pump chamber 1 to drive the fuel pump diaphragm 8 to produce reciprocating movement, when the operator squeezes the purge bulb 3, the air of carburetor will be discharged out to the fuel container through a fuel purge passage 14 (see bulb outlet passage 18 in FIG. 11), and a portion of the fuel will enter the fuel pump chamber 1 through the (pump power) prime force transmission passage 10 at the bottom (bottom wall 22) of the purge bulb 3, the fuel pump diaphragm 8 drives the fuel in the fuel enrichment chamber 12, the fuel is ejected from the check valve with a metering jet 11 of the fuel enrichment starting passage.

In the embodiment, the inlet of the fuel inlet passage 9 is provided with a check valve 4 with the spring.

In the embodiment, the fuel enrichment starting passage 13 is provided with a check valve with a metering jet 11. The fuel in the fuel enrichment chamber 12 go through the check valve with a metering jet 11 into the throttle bore 5 of carburetor, and the aperture flow of the different engine metering jet may be different, depending on the match of the carburetor, as well, by changing the shape, diameter or depth of the fuel enrichment chamber 12 to change the amount of fuel pump, the engine can be matched by above means, but not limited by the above.

In the embodiment, the check valve with a metering jet 11 is provided with a spring.

In the embodiment, the fuel enrichment starting passage 13 is also provided with a pressure balance hole 15 and connects with the air of the choke direction, the purpose is to avoid the engine in the normal work to generate the negative pressure, actively suck out the fuel from the starting fuel enrichment chamber of carburetor.

Figure 8:
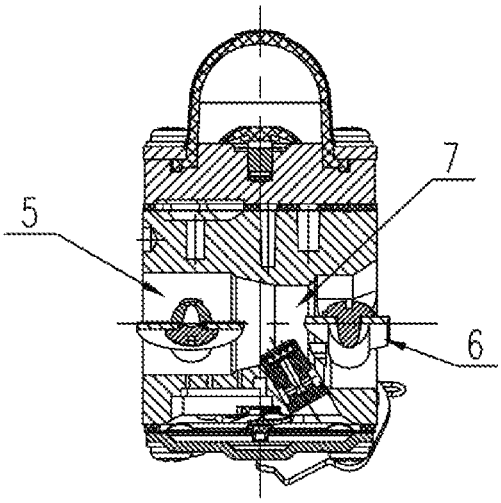
FIG. 8 is a D-D section view of the embodiment of FIG. 1 in accordance to the present invention, the fuel enrichment simple starting device and method of carburetor.
Figure 9:
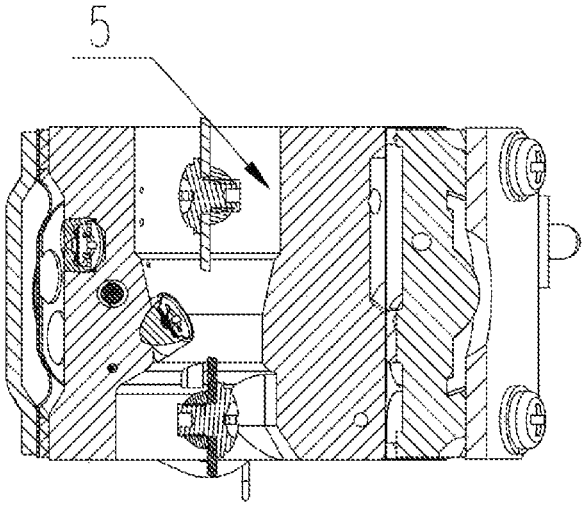
FIG. 9 is a E-E section view of the embodiment of FIG. 3 in accordance to the present invention, the fuel enrichment simple starting device and method of carburetor.

As shown in FIG. 8, a D-D section view of the embodiment of FIG. 1 in accordance to the invention, the fuel enrichment simple starting device and method of carburetor.

In the embodiment, a venturi 7 is provided between the throttle bore 5 and the choke 6.

In the embodiment, the fuel pump diaphragm 8 forms a pump with the fuel inlet passage 9 and the check valve in the fuel enrichment starting passage 13 (as shown in FIG. 7). When the operator squeezes the purge bulb 3, the start fuel under the pressure of the fuel pump diaphragm 8 is injected into the carburetor through the check value of the fuel enrichment starting passage 13, the check valve 4 of the fuel inlet passage 9 is closed at this time; when the operator releases the purge bulb 3, the self-resilience of the purge bulb 3 forms a negative pressure against the fuel pump diaphragm, at this time the check valve of the fuel inlet passage 9 is opened, and suck in the fuel, the check valve with a metering jet 11 of the fuel enrichment starting passage 13 is closed, the fuel cavity is filled with fuel, to prepare for the second fuel injection cycle.

Figure 10:
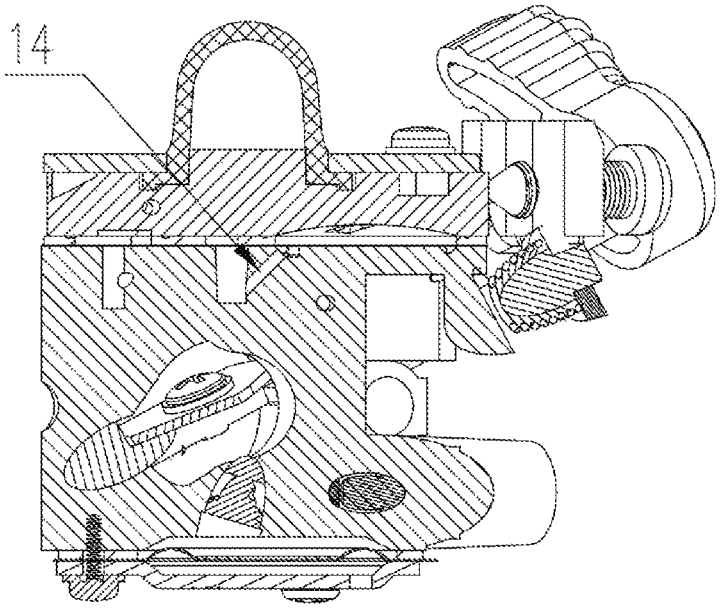
FIG. 10 is a F-F section view of the embodiment of FIG. 4 in accordance to the present invention, the fuel enrichment simple starting device and method of carburetor.

The working principle of the fuel enrichment simple starting device of carburetor in the present invention, when the operator squeezes the purge bulb, a positive pressure is generated during the pressing operation, and a negative pressure is generated during the releasing operation, the bottom of the purge bulb has a hole connecting with the fuel pump chamber 1, the positive pressure and the negative pressure are introduced into the fuel pump chamber 1 to drive the fuel pump diaphragm 8 to produce reciprocating movement. When the operator squeezes the purge bulb, the air of carburetor will be discharged out through a fuel purge passage 14, and a portion of the fuel will enter the fuel pump chamber 1 through the prime force transmission passage 10 at the bottom of the purge bulb 3, the fuel pump diaphragm 8 drives the fuel in the fuel enrichment chamber 12, the fuel is ejected from the check valve with a metering jet 11 of the fuel enrichment starting passage 13; when the operator releases the purge bulb 3, a negative pressure generated by the purge bulb 3, and the fuel in the fuel container is sucked into the (measuring) metering chamber 2 of the carburetor, the excess fuel enters the fuel enrichment chamber 12 and the fuel purge passage 14 (as shown in FIG. 10) of the carburetor, so repeatedly, the fuel is injected into the throttle bore 5 of the carburetor from the fuel enrichment starting passage 13.

The fuel enrichment simple starting method of carburetor, comprising the following steps:

First step, squeeze the purge bulb, pre-inject the quantitative fuel;

Second step, close the choke;

Third step, pull the engine starter to the engine running;

Fourth step, increase and decrease the throttle to normal running.

The starting method has the advantages of simple operation, less starting times and easy to start at low temperature (such as 0° C.).

Squeeze the purge bulb, that is a standard step when the engine starts, the purpose is to suck the fuel of the fuel container into the metering chamber 2 of the carburetor, after the metering chamber 2 of carburetor is filled with fuel, more fuel will through the fuel purge passage 14, and return to the fuel container by the duckbill check valve.

In the embodiment, the first step, when the operator squeezes the purge bulb, a positive pressure is generated during the pressing operation, and a negative pressure is generated during the releasing operation, and use the positive pressure generated when squeeze the purge bulb, pre-inject the quantitative fuel into the throttle bore 5, and then use the choke of the large volume air to achieve simple start.

In the embodiment, the bottom of the purge bulb 3 has a prime force transmission passage 10 leading into the fuel pump chamber 1, the positive pressure and the negative pressure are introduced into the fuel pump chamber 1 to drive the fuel pump diaphragm 8 to produce reciprocating movement, when the operator squeezes the purge bulb 3, the air of carburetor will be discharged out through a fuel purge passage 14, and a portion of the fuel will enter the fuel pump chamber 1 through the (pump power) prime force transmission passage 10 at the bottom of the purge bulb 3, the fuel pump diaphragm 8 drives the fuel in the fuel enrichment chamber 12, the fuel is ejected from the check valve with a metering jet 11 of the fuel enrichment starting passage 13.

In the embodiment, when the operator releases the purge bulb 3, a negative pressure generated by the purge bulb 3, and the fuel in the fuel container is sucked into the metering chamber 2 of the carburetor, the excess fuel enters the fuel enrichment chamber 12 and the fuel purge passage 14 of the carburetor, so repeatedly, the fuel is injected into the throttle bore 5 of the carburetor from the fuel enrichment starting passage 13 to achieve start.

In the embodiment, when the operator squeezes the purge bulb 3, the start fuel under the pressure of the fuel pump diaphragm 8 is injected into the carburetor through the check value of the fuel enrichment starting passage 13; the check valve 4 of the fuel inlet passage 9 is closed at this time.

In the embodiment, when the operator releases the purge bulb 3, the self-resilience of the purge bulb 3 forms a negative pressure against the fuel pump diaphragm, at this time the check valve of the fuel inlet passage 9 is opened, and suck in the fuel, the check valve with a metering jet 11 of the fuel enrichment starting passage 13 is closed, the fuel cavity is filled with fuel, to prepare for the second fuel injection cycle.

In the embodiment, the choke 6 is a choke of the large volume air, compared with the present technique, the choke panel area is small, increase air volume, and the size of the choke panel depends on the matching of the different engines. Increasing air volume when the engine start, compared with the present technique, the user do not need to manually open the choke to ½ position, to achieve preheat engine.

Embodiment 2

Another structure schematic view of optimal embodiment in accordance to the present invention, the fuel enrichment simple starting device and method of carburetor; a separated remote control structure is used between the purge bulb 3 and the main body of the carburetor, the purge bulb 3 and the main body of the carburetor are connected by a Fuel tube 16. Other structures and operations are same with the first embodiment, and therefore, the description will be omitted.

In summary, the fuel enrichment simple starting device and method of carburetor in the invention has the following advantages: use pre-injection technology to achieve engine fuel enrichment start, that is, in the first step squeeze the purge bulb, pre-inject the quantitative fuel, and then use the choke of the large volume air to achieve simple start; simple operation, less starting times and easy to start at low temperature (such as 0° C.).

Specific embodiments described above, the technical problem solved by the present invention, technical solutions, and beneficial effects were further explanation. It should be understood that the above description is only the specific embodiments of the present invention, and not limit the invention, within the spirit and principles of the present invention, made any modifications, equivalent replacements and improvements; they should be included in the scope of the invention as defined by claims.

The invention claimed is:

1. A fuel enrichment simple starting device, for a carburetor for use with an engine having a fuel tank, the carburetor comprising:

a fuel pump having a fuel pump chamber, a fuel enrichment chamber, and a reciprocating pump diaphragm between said fuel pump chamber and said fuel enrichment chamber;

a metering chamber adapted to receive fuel from the fuel tank;

a fuel inlet passage adapted to carry fuel from the metering chamber to the fuel enrichment chamber;

a choke for adjusting air flow from an air intake to the throttle bore;

and a purge bulb having a bulb interior space with a bottom wall, and a bulb check valve in the bottom wall and having an outer perimeter, the bulb interior space being fluidly connected to a fuel purge passage comprising a bulb inlet passage for receiving fuel into the bulb interior space and an bulb outlet passage for expelling fuel in the bulb interior space to the fuel tank, wherein the bulb check valve is adapted to close the bulb inlet passage and open the bulb outlet passage and when the bulb is squeezed, and adapted to close the bulb outlet passage and open the bulb inlet passage when the bulb is released;

the improvement comprising:

the fuel enrichment simple starting device comprising a fuel enrichment starting passage extending from the fuel enrichment chamber to the throttle bore, and a prime force transmission passage extending from the bulb interior space to the fuel pump chamber, wherein the prime force transmission passage has a first end fluidly connected to the bulb interior space by a hole in said bottom wall and having a second end that opens into the fuel pump chamber, said hole in the bottom wall being distanced from the bulb check valve so that the hole is outside of said outer perimeter, so that, when the bulb is squeezed, a portion of the fuel in the bulb interior space flows through said hole into the fuel pump chamber to drive the diaphragm toward the fuel enrichment chamber, so that fuel in the fuel enrichment chamber is forced through the fuel enrichment starting passage into the throttle bore, whereby the throttle bore is pre-injected with fuel to increase fuel-to-air ratio before starting the engine.

2. The fuel enrichment simple starting device of claim 1, wherein said fuel inlet passage comprises a check valve with a spring so that, when the squeezing of the bulb drives the diaphragm toward the fuel enrichment chamber, said check valve with a spring closes said fuel inlet passage.

3. The fuel enrichment simple starting device of claim 1, wherein the fuel enrichment starting passage comprises a check valve with a metering jet.

4. The fuel enrichment simple starting device of claim 1, wherein the choke is in a choke bore and the fuel enrichment starting passage is further provided with a pressure balance hole connected to the air of the choke bore.

5. The fuel enrichment simple starting device of claim 1, wherein the choke is in a choke bore and a venturi is provided between the throttle bore and the choke bore.

6. The fuel enrichment simple starting device of claim 1, wherein the pump diaphragm cooperates with said check valve with a spring and said check valve with a metering jet to pump fuel.

7. The fuel enrichment simple starting device of claim 1, wherein the bulb is distanced from a main body of the carburetor, and said bulb inlet passage, said bulb outlet passage, and said prime force transmission passage are fuel tubes connecting said bulb to the main body of the carburetor.

8. A fuel enrichment simple starting method for a carburetor for use with an engine having a fuel container, the carburetor having a purge bulb with a bulb interior space, a choke, and a throttle bore, and an engine starter, the method comprising the following steps:

a first step of squeezing the purge bulb to pre-inject a quantitative amount of fuel into the throttle bore;

a second step of closing the choke;

a third step of pulling the engine starter to get the engine running; and a fourth step of increasing and decreasing the throttle to achieve normal engine running;

wherein the carburetor further has a fuel pump chamber, a fuel enrichment chamber, and a fuel pump diaphragm between the fuel pump chamber and the fuel enrichment chamber;

wherein a bottom of the purge bulb has a bulb check valve with an outer perimeter; and wherein the carburetor further has a prime force transmission passage having a first end at a hole in the bottom of the purge bulb at a location distanced from the bulb check valve and outside of said outer perimeter, and a second end at the fuel pump chamber; and wherein said squeezing the purge bulb pre-injects said quantitative amount of fuel into the throttle bore by forcing fuel from the bulb interior space through the prime force transmission passage and into the fuel pump chamber, so that the fuel pump diaphragm forces said quantitative amount of fuel out of the fuel enrichment chamber, through a fuel enrichment starting passage, and into the throttle bore.

9. The fuel enrichment simple starting method of claim 8, wherein said first step forms a first fuel injection cycle, and, after said first step, the purge bulb is released to form a negative pressure that sucks fuel from the fuel container into a metering chamber of the carburetor, and excess fuel enters the fuel enrichment chamber and a fuel purge passage of the carburetor, and repeated squeezing and releasing of the purge bulb causes additional fuel to be injected into the throttle bore of the carburetor from the fuel enrichment starting passage in a second fuel injection cycle.

* * * * *